United States Patent [19]

Canonne

[11] 4,034,322

[45] July 5, 1977

[54] DEVICE FOR PROTECTION AGAINST CURRENT OVERCHARGES

[75] Inventor: Paul Canonne, Barentin, France

[73] Assignee: Societe d'Apparetillage Electrique Saparfi, Saint-Marcellin, France

[22] Filed: Nov. 11, 1975

[21] Appl. No.: 631,155

[30] Foreign Application Priority Data

Nov. 15, 1974 France ..... 74.37703

[52] U.S. Cl. ..... 335/42; 337/99

[51] Int. Cl.² ..... H01H 77/06

[58] Field of Search ..... 335/42, 39, 44, 45, 335/176, 35; 337/99

[56] References Cited

UNITED STATES PATENTS

| | | | |
|---|---|---|---|
| 2,810,803 | 10/1957 | Green | 335/39 |
| 3,165,609 | 1/1965 | Norden | 335/44 |
| 3,315,054 | 4/1967 | Langley | 337/99 |

*Primary Examiner*—Harold Broome

[57] ABSTRACT

A device for protection against current overcharges comprising on a same mounting plate a thermal protection device constituted by an active bimetal fixed on the mounting plate, a compensating bimetal fixed on a striker which is movable about a pivot, a shield separating the bimetals and a magnetic protection device constituted by a relay whose armature is held at rest, in spaced relation from the magnetic circuit by a spring whose tension is adjustable.

7 Claims, 5 Drawing Figures

DEVICE FOR PROTECTION AGAINST CURRENT OVERCHARGES

FIELD OF THE INVENTION

The present invention relates to a device for the protection of electrical appliances against long overcharges and instantaneous overcharges of electric current.

BACKGROUND

When the intensity of the electric current exceeds, during a certain time, the rated intensity of an appliance, it is necessary to cut off the electrical supply in order to avoid any damage to that appliance by excessive overheating. A bimetal through which the electric current flows to deform it by heating, is currently used against long overcharges, to cause the cutting off of the electric current, the cut-off occurring more or less rapidly as a function of the intensity of the current. When that intensity is greater than the rated intensity, this protection is called thermal protecton and comes into play for intensities generally not exceeding twice the rated intensity in the operating state.

In the case of instantaneous overcharges of current, a relay having a winding traversed by the electric current and an armature subjected to the action of a return spring are used; when a great overcharge of current occurs, even momentarily, the blade is attracted and the movement thereof controls the cutting off of the electricity supply; this type of protection is called magnetic protection and generally comes into play for intensities whose instantaneous value exceeds twice the rated intensity.

Thermal and magnetic protection are provided separately and are used more particularly in circuit-breakers; they are generally very bulky and difficult to adjust and their characteristics vary in time; moreover, the compensation of thermal devices on multi-pole circuit-breakers is generally not provided on each device, but is provided by a single compensating bimetal which then provides only an average and hence imperfect compensation.

SUMMARY OF THE INVENTION

The present invention seeks to obviate the disadvantages of the known protection devices and to provide thermal and magnetic protection devices having a small mass and which are reliable, regular in operation and easy to adjust.

The device for protection against current overcharges according to the invention comprises a thermal protection device and a magnetic protection device fixed on a common mounting plate.

According to another feature, the thermal protection device comprises an active bimetal fixed on the mounting plate and a compensating bimetal parallel to the active bimetal and integral with a striker pivoting with a pivot supported by the mounting plate, the bimetal being separated by a shield.

According to another feature, the magnetic protection device is constituted by a relay comprising, on a magnetic core and insulated from it, a winding and a movable armature, held at rest away from the magnetic core by a spring whose tension is adjustable.

BRIEF DESCRIPTION OF THE DRAWING

Other features and advantages of the invention will become apparent from the following description of an embodiment given only by way of an example and illustrated by the accompanying figures, in which.

DETAILED DESCRIPTION

The same reference symbols used in the different figures have, of course, the same significance.

Figure 1:
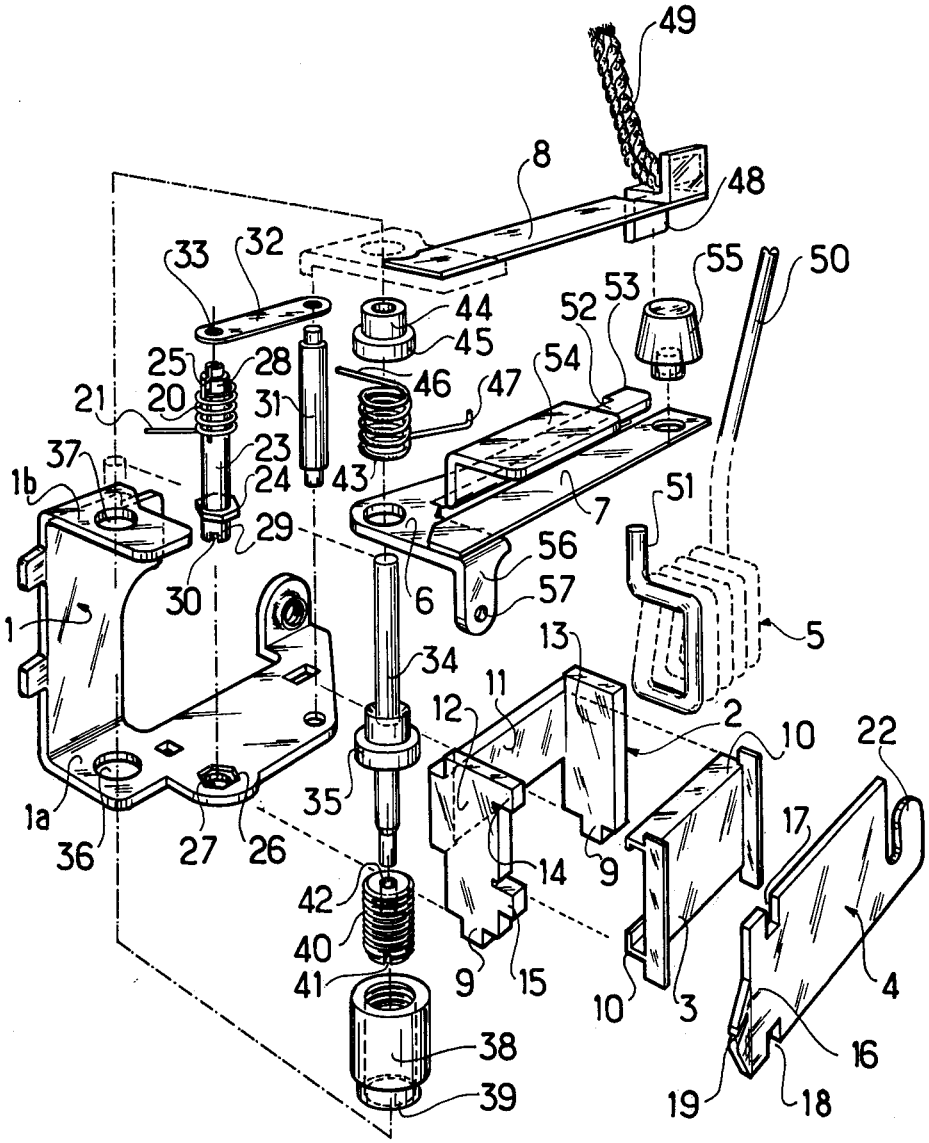
FIG. 1 is an exploded view of the protection device according to the invention.

The device for protection against overcharges of electric current shown in the exploded view in FIG. 1 comprises: a mounting plate 1 which has two tabs 1*a* and 1*b* and is used as a support for the device as a whole, a magnetic circuit 2, an insulating half frame 3, an armature 4, a winding 5, a striker 6, a compensating bimetal 7, and an active bimetal 8. The magnetic circuit comprises two supports 12 and 13 and is fixed on the mounting plate 1 by tabs 9 on the supports 12 and 13; the insulating half frame 3 has two fixing tabs 10 which enable, by flexible deformation of the said insulating half frame, the fixing thereof on the yoke 11 of the magnetic circuit 2. The support 12 comprises two tabs 14 and 15 between which the end 16 of the armature is received. The armature has two notches 17 and 18 in which the tabs 14 and 15 respectively of the support 12 are accomodated. The end 16 of the armature 4 has a recess 19 in which the end 21 of a spring 20 is recrived which acts as a return spring on the armature and opposes the pressing thereof against the support 13 of the magnetic circuit. A copper wire insulated by a varnish, as in conventional configurations, is wound on the insulating frame and constitutes the winding 5 one of whose ends 51 is fixed on the mounting plate 1 by welding for example, the other end 50 being used as an electrical current inlet; the wire of the winding, being rigid, does not touch the magnetic circuit between the fixing tabs 10 of the insulating frame 3; the armature 4 has another end 22 which is used for controlling the cutting off of an electrical supply when the armature is attracted by the magnetic circuit under the action of an overvoltage. The spring 20 is wound around an adjusting pin 23, one of its ends being engaged in a slot 25 at the end 28 of the adjusting pin; the adjusting pin comprises, near another end 29, a polygonal collar 24 which is, for example, hexagonal and is accomodated in a polygonal portion 26 which is, for example, hexagonal, of a hole 27 in the mounting plate 1, having the same diameter as the end 29, when the end 29 of the said adjusting shaft is engaged in the hole 27; the end 29 has a slot 30 whose function will be specified further below. A support rod 31 is crimped at one end in the mounting plate 1 close to the support 13 of the magnetic circuit; a blocking spring 32 in the form of a strip plate has a hole 33 at one end in which the end 28 of the adjusting pin 23 is engaged and the spring 32 is crimped at its other end to the support rod 31.

The striker 6 pivots around a pivot 34 and is fixed by crimping onto a shoulder 35 of the pivot which is installed between the two tabs 1*a* and 1*b* of the mounting plate each of which has a hole 36, 37 respectively. The pivot is installed as follows: an internally threaded pivot socket 38 has a machine-made end 39 which is engaged in the hole 36; an insulating center-casting 40 provided with a slot 41 at one end is screwed into the pivot socket, the slot 41 being on the same side as the end 39 of the pivot socket. The center casting 40 comprises at its other end a blind hole 42 in which one end of the pivot 34 is inserted; fitted on the pivot 34 are a striker spring 43, and an insulating bearing 44 which is engaged in the hole 37 of the tab 1*b* of the mounting plate and abuts against the tab 37 by a shoulder 45. The striker spring 43 comprises an insulated end 46 which presses against the mounting plate and an end 47 which presses against the striker 6. One end of the active bimetal 8, whose other end comprises a bimetal stop 48 provided with a braided wire for the supplying of electric current is fixed, for example, by welding on the tab 1*b*. The striker 6 comprises a branch 52 whose curved end 53 is turned towards the tab 1*b* of the mounting plate; the branch 52 comprises, over its length, a portion which is bent at right-angles, called a shield 54, which is situated between the active bimetal 8 and the compensating bimetal 7. One end of the compensating bimetal is fixed, for example, by a weld on the striker, in the vicinity of the pivot; the other end is free and a compensator stop 55 having a given height is fixed thereto; the stop 55 preferably has a truncated conical shape, which is, to great advantage, polished and presses, over a length equal at most to its height, against the bimetal stop 48; the striker also comprises, close to the pivot, a tab 56 with a hole 57.

Figure 2:
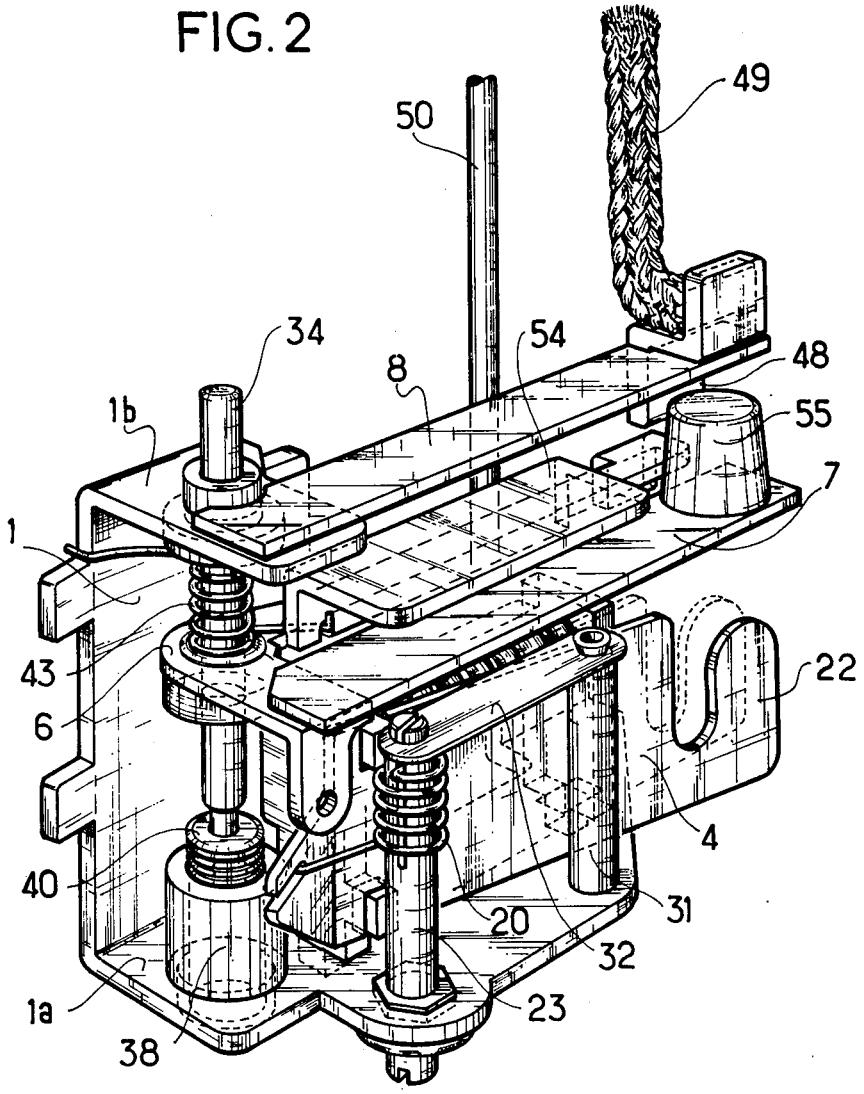
FIG. 2 is a perspective view of the protection device.

FIG. 2 is a perspective view of the assembled device for protection against overcharges of current, in which the various elements which constitute it may be distinguished.

Figure 3:
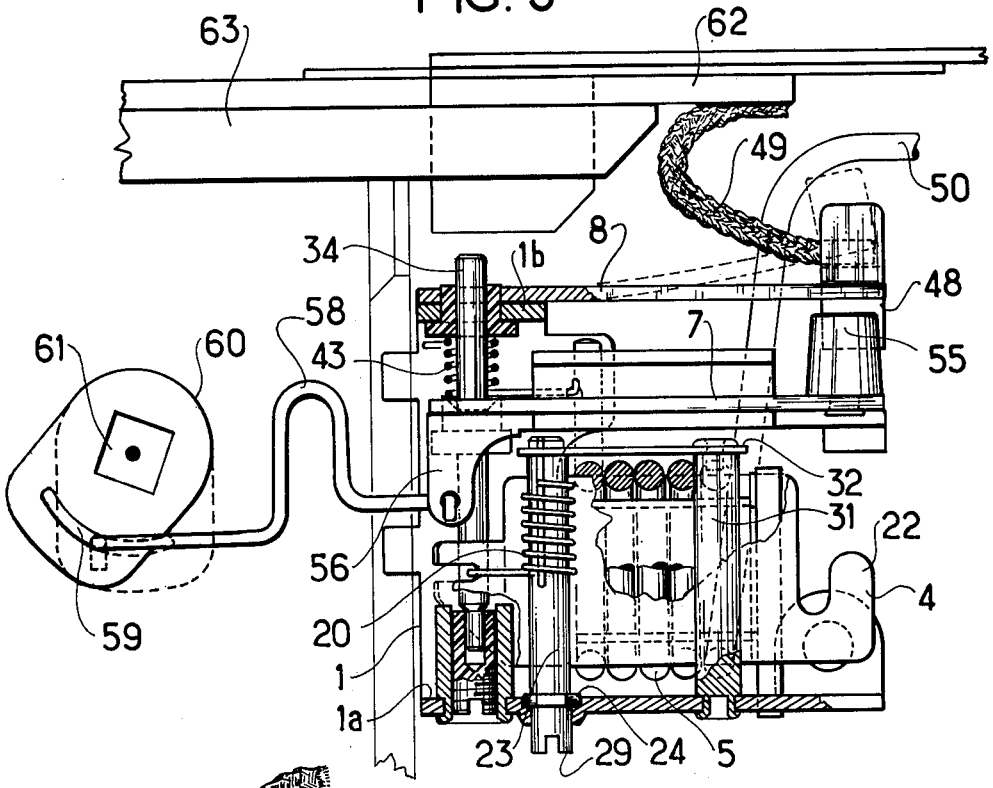
FIG. 3 is a front view of the device of FIG. 2.

FIG. 3 is a front view of the device for protection against overcharges shown in FIG. 2; in that figure, besides the components described in FIG. 1, there is seen a return rod 58 one of whose curved ends is engaged in the hole 57 of the tab 56 of the striker and whose other curved end is engaged in a slot 59 of a return cam 60 having a square hole 61 intended for receiving a square axle, not shown, which controls the opening and the closing of the contacts of a circuit breaker with which the device for protection against overcharges of current is connected. The resilient electrical conductor 49 is fixed to a metallic bar 62 used as a current inlet terminal and itself fixed on an insulating support 63; the said insulating support and the said metallic bar do not form a part of the device for protection against overcharges of current which is the object of the invention.

Figure 4A:
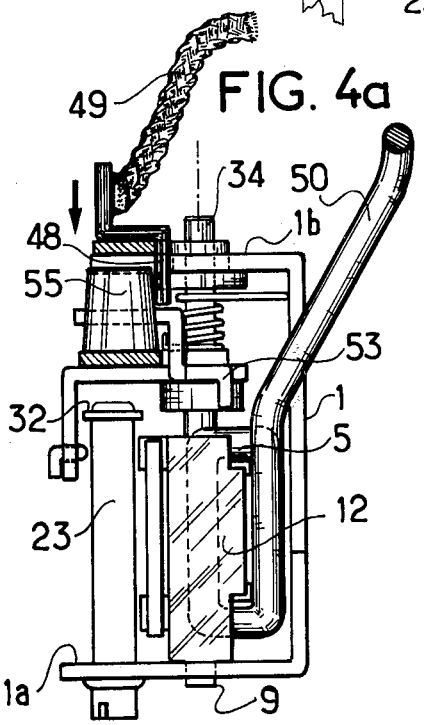
FIGS. 4*a* and 4*b* show the protection device in FIG. 3 seen from the right, the thermal protection being at rest in FIG. 4*a* and released in FIG. 4*b*.
Figure 4B:
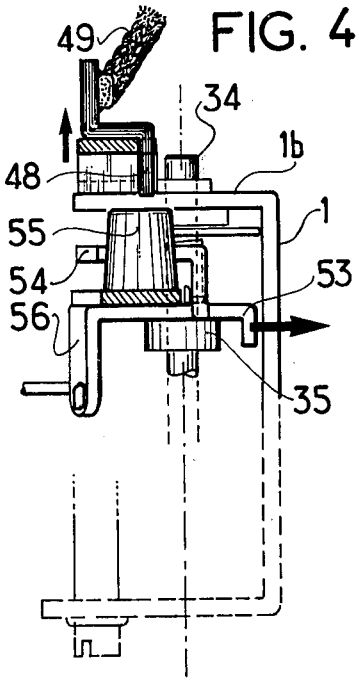

Lastly, FIGS. 4*a* and 4*b* are views from the right in FIG. 3; in FIG. 4*a*, the thermal protection device is at rest; in FIG. 4*b*, the thermal device is shown in the released position; this case corresponds to that of a permanent overvoltage which causes a deforming of the active bimetal 8.

The operation of the device for protection against overcharges of current is as follows: in the rest position shown in FIG. 2, the resilient electrical conductor 49 and the end 50 of the winding 5 are connected to current input terminals, the active bimetal 8 and the winding 5 have a current whose intensity is at most equal to the rated intensity of the appliance to be protected flowing through them. Under the action of the striker spring 43, the striker pivots and the compensator stop 55 fixed to the end of the compensation bimetal 7 comes into contact with the bimetal stop 48 welded to the end of the active bimetal 8; the said bimetal stop therefore opposes the rotating movement of the striker.

The shield 54 situated between the active bimetal 8 and the compensating bimetal 7 protects the latter from all radiation emitted by the active bimetal when the latter has an electric current flowing through it; the active and compensating bimetal being installed in the immediate vicinity of each other, this arrangement ensures an excellent compensation, for the bimetals are practically subjected to the same local temperature variations, a condition which is necessary for good compensation. When the intensity of the electric current is greater than the rated current, the active bimetal 8 is deformed by heating as shown by the dotted lines in FIG. 3, driving in its movement, the bimetal stop 48, which releases the compensator stop 55. The striker 6, no longer being retained, pivots under the action of the striker spring 43; upon moving, the curved end 53 of the branch 52 of the striker transmits a release signal to a release mechanism, not shown, for the circuit-breaker connected with the device for protection against overcharges of current; this signal is transmitted, for example, by a rod, not shown, which moves under the action of the curved end 53 when the striker pivots; the relative positions of the active bimetal 8, of the striker 6 and of the compensator stop 55 are shown in FIG. 4*b*, at the moment of the release, that is, at the moment when the striker 6 is released. The release signal is therefore transmitted by the rod to a release mechanism which controls the opening of the contacts of the circuit-breaker by rotation of a shaft which controls the opening and the closing of the said contacts, that shaft driving, in its rotation, the return cam 60 which was in the position shown by the dotted lines in FIG. 3, said position corresponding to the tripped circuit-breaker. The return cam 60 driven in a rotating movement by the shaft in its square hole 61 assumes the position shown in solid lines in FIG. 3; the return rod 58 is driven by the said return cam to cause the striker 6 to rotate in a direction opposite to that of its rotation when it has been released, making it overstep by a few degrees its original position, that is, contact between the bimetal stop 48 and the compensator stop 55, so as not to hinder the return of the active bimetal to its rest position when it cools. When the circuit-breaker is cocked again, (tripped position) the return cam 60 pivots to assume the position shown in dotted lines in FIG. 3, thus releasing the return rod 58 and hence the striker 6 and the compensator stop 55 presses against the bimetal stop 48, as shown in FIG. 4*a*. The length of the compensator stop 55 in contact with the bimetal stop 48 is adjustable by turning the center-casting 40, by means of a screwdriver, using the slot 41 for that purpose; the center-casting entering more or less deeply in the pivot socket 38 enables the pivot 34 to move and to compress, more or less, the stroker spring 43 wound around the said pivot; the stroker therefore moves with the pivot 34 to which it is fixed and drives the compensator stop 55 in its movement, the bimetal stop 48 remaining stationary.

It will therefore be seen that by actuating the center-casting 40, the distance between the active and compensating bimetals and hence the length of the compensator stop in contact with the bimetal stop is adjusted with precision, thus adjusting being effected without any deformation of any of the bimetals. The truncated conical shape of compensator stop 55 coming in contact with a planar portion of the bimetal stop 48 minimizes friction, especially if care is taken to form the compensator stop 55 and the bimetal stop 48 with materials having a different hardness, are inoxidizable and the said stops are polished. It will be observed, and this is also an important characteristic of the invention, that when the compensator stop presses against the bimetal stop, under the action of the striker spring, the force exerted on the compensating and active bimetals is perpendicular to the edge which therefore corresponds to the greatest mechanicanical rigidity of the bimetals which are not in danger of being deformed by bending; this arrangement contributes to the precision, regularity in operation and reliability of the thermal protection device; the striker spring which permanently presses the striker fixed to the pivot cancels all spurious play in the distance between the active and compensating bimetals. Moreover and contrary to known thermal protection devices, the active bimetal is not required to exert a force on a release device of the circuit-breaker, this always resulting in a loss of sensitivity; in the invention, it is the striker which exerts the necessary force as soon as it is released, its release being obtained by the deformation of the active bimetal, this deformation only having to overcome a very slight friction force between the bimetal stop and the compensator stop, said friction force being at least 10 times less than that which the bimetal must exert in known thermal protection devices. Lastly, by imparting a different shape to the threads of the center casting and of the pivot socket, self-locking of the center-casting in the pivot socket is obtained, making it impossible to interfere with the adjustment of the distance between the active and compensating bimetal; self-locking is obtained, for example, by a round thread end on the center-casting made of relatively resilient insulating material and a normal thread in the pivot socket.

The operation of the magnetic protection device is as follows: when the winding 5 is traversed by an electric current whose intensity is at most equal to the rated value of the appliance to be protected, the armature 4 is not attracted by the magnetic circuit 2, but being subjected to the action of the spring 20, it abuts against the support rod 31, the distance between the armature and the magnetic circuit 2 being determined by construction. When the intensity assumes an instantaneous value corresponding to a determined value, for example three times the rated intensity, the armature is attracted by the magnetic circuit, the force of attraction being greater than the force exerted by the spring 20. On moving, the end 22 of the blade transmits a release signal to a mechanism, not shown, for releasing the circuit-breaker, connected with the magneto-thermal device; this signal is transmitted, for example, by a rod which moves under the action of the end 22 of the armature, the said rod being preferably the same as that transmitting the release signal of the thermal protection device previously mentioned. When the release of the circuit-breaker has taken place, no further electric current flows through the winding and the armature returns to the abutting position, under the action of the spring 20, against the support rod 31. The instantaneous value of the intensity of the electric current which causes the attracting of the armature depends on the force exerted on the latter by the spring 20; that force is adjusted by means of a screw-driver inserted in the slot at the end 29 of the pin 23, said pin being pushed in order to clear its polygonal collar 24 from the polygonal portion 26 of the tab 1*a* of the mounting plate, said pin being held at the other end 28 by the blocking spring 32, the pin 23 is then made to turn, thus winding or unwinding, according to the direction of rotation, the spring 20 one of whose ends is engaged in the slot 25 of the end 28. When the pin is no longer pushed, the polygonal collar 24 returns to its place in the polygonal portion 26, the pin being subjected to the action of the blocking spring 32. It is thus possible to make the pin rotate by 60° or by a multiple of 60°, in the case of a hexagonal collar and therefore, in that manner, to make the force exerted by the spring 20 on the armature vary, that is, to adjust the instantaneous value of the intensity which causes the attracting of the armature. Of course, a finer adjustment can be obtained by using an octagonal or dodecagonal collar, instead of a hexagonal collar, in order to provide rotations of the pin 23 by a few degrees only. That arrangement enables a precise adjustment of the instantaneous value of the intensity at which the blade is attracted; the self-locking of the pin 23 ensured by the fitting of the polygonal collar 24 in the tab 1*a* of the mounting plate makes it impossible to interfere with that adjustment and confers great reliability thereon. The distance between the armature and the magnetic circuit, that is, the air gap, can also be adjusted, during production, using, for that purpose, a support rod having a greater or smaller diameter; the armature abutting against the support rod, the air gap still has the same value and this is also an essential condition for obtaining high regularity of operation of the magnetic protection device, since this also conditions the value of the intensity at which the armature is attracted for a given force exerted by the spring 20.

In the example described, the active bimetal 8 and the winding 5 have the same electric current flowing through them and the device for protection against overcharges of current is connected in series with the appliance to be protected; in the case where the intensity of the current in the appliance to be protected is greater than the intensity which the device can normally bear, a shunt is connected in parallel with the device, that shunt being connected, for example, between the metallic bar 62 and the end 50 of the winding 5, FIG. 3. The shunt can evidently have a variable resistance which is, to great advantage, switchable, so as to enable different calibres of use.

It must be understood that the invention is in no way limited to the embodiments described and illustrated, which have been given only by way of an example; more particularly, without going beyond the scope of the invention, certain arrangements can be modified or certain means can be replaced by equivalent means.

I claim:

1. A device for protection against overcharges of current, comprising a thermal protection device and a magnetic protection device fixed on a mounting plate (1), the thermal protection device comprising an active bimetal (8), a compensating bimetal (7) parallel to the active bimetal and a shield (54) situated between the active bimetal and the compensating bimetal, the magnetic protection device being constituted by a relay comprising, on a magnetic circuit (2) and insulated therefrom, a winding (5) and a movable armature (4), characterized in that the said mounting plate comprises two tabs (1*a*, 1*b*) in that the magnetic protection device is fixed on one (1*a*) of the said tabs, in that the active bimetal (8) is fixed by one end on another tab (1*b*) of the mounting plate, in that the compensation bimetal (7) is fixed by one end to a striker (6) integral with a pivot (34) installed between a tab (1*b*) by an insulating bearing (44) and another tab (1*a*) of the mounting plate, in that the said striker is fixed against a shoulder (35), in that a striker spring (43) is wound around one end of the said pivot between the said bearing (44) and the said striker, the said striker spring having one insulated end (46) fixed to the mounting plate and one end (47) fixed to the striker and exerting a pivoting force on the said striker and in that the compensating bimetal (7) comprises, at one free end, a compensator stop (55), having a given height, in contact, under the action of the said striker spring and over a length at most equal to its height, with a bimetal stop (48) fixed to one end of the active bimetal opposite to that by which it is fixed onto the mounting plate.

2. A device for protection against overcharges of current according to claim 1, characterized in that one end of the pivot opposite to the end around which the striker spring (43) is wound, is installed in an externally threaded center-casting (40), the said center-casting being screwed into an internally threaded pivot socket (36) which bears against a tab (1*a*) of the mounting plate and being used for adjusting the length of the compensator stop (55) in contact with the bimetal stop (48) and that the threads of the center-casting and of the pivot socket have a different shape which ensures self-locking of the center-casting in the pivot socket.

3. A device for protection against overcharges of current according to claim 2, characterized in that the shield (54) is constituted by a portion of the striker (6).

4. A device for protection against overcharges of current according to claim 1, characterized in that the winding (5) of the relay is insulated from the magnetic circuit (2) by an insulating half frame (3) comprising two fixing tabs (10) for the fixing thereof by flexible deformation of the said fixing tabs on a yoke (11) of the magnetic circuit.

5. A device for protection against overcharges of current according to claim 1, characterized in that the relay comprises an armature (4) which is movable about one end of a support (12) of the magnetic circuit comprising two support (12, 13) the said armature being subjected to the action of a spring (20) wound around one end (28) of an adjusting pin (23), the said adjusting spring having one end fixed to the end (28), of the said adjusting pin and extering by another end (21) a force on the armature to keep it away from the other support (13) of the magnetic circuit, the said armature abutting against a support rod (31) fixed by one end to a tab (1*a*) of the mounting plate.

6. Device for protection against overcharges of current according to claim 5, characterized in that the adjusting pin (23) comprises at one cylindrical end (29) a polygonal collar (24) which fits into a polygonal portion (26) of a hole (27) in a tab (1*a*) of the mounting plate, the said hole having the same diameter as that of the end (29) of the adjusting pin whose opposite end (28) is fitted into a locking spring (32) fixed on one end of the support rod (31) and applying the said polygonal collar (24) in the said polygonal portion (26) and that the adjusting of the affort exerted by the spring (20) on the armature is obtained by pressing the end (29) of the said adjusting pin and making it turn.

7. A device for protection against overcharges of current according to claim 6, characterized in that the striker (6) comprises a tab (56), in that one end of a return rod (58) is inserted in a hole (57) of the said tab (56), in that one end of the said return rod is inserted in a slot (59) of a return cam (60) fixed by a square hole (61) on a control shaft for the contacts of a circuit-breaker, the said shaft assuming, by rotation, two positions, one corresponding to the tripping and the other to the release of the circuit-breaker, the said return cam bringing the striker back into the rest position after a release by permanent overcharge of current, the said return cam (60) assuming, by action of the control shaft, a position corresponding to the release of the circuit-breaker.

* * * * *